US009797651B2

(12) United States Patent
Mukherjee

(10) Patent No.: US 9,797,651 B2
(45) Date of Patent: Oct. 24, 2017

(54) SYSTEM FOR FACILITATING COMMUNICATION OF INFORMATION AND RELATED METHODS

(71) Applicant: Somnath Mukherjee, Milpitas, CA (US)

(72) Inventor: Somnath Mukherjee, Milpitas, CA (US)

(73) Assignee: FLUID MANAGEMENT SYSTEMS, INC., Lexington, KY (US)

( * ) Notice: Subject to any disclaimer, the term of this patent is extended or adjusted under 35 U.S.C. 154(b) by 824 days.

(21) Appl. No.: 14/085,005

(22) Filed: Nov. 20, 2013

(65) Prior Publication Data

US 2014/0137586 A1 May 22, 2014

Related U.S. Application Data

(60) Provisional application No. 61/728,964, filed on Nov. 21, 2012.

(51) Int. Cl.

| | |
|---|---|
| ***F25B 49/00*** | (2006.01) |
| ***F25D 21/00*** | (2006.01) |
| ***G05B 11/01*** | (2006.01) |
| ***G05B 13/02*** | (2006.01) |
| ***G01M 1/38*** | (2006.01) |
| ***F25D 29/00*** | (2006.01) |

(52) U.S. Cl.
CPC ..... *F25D 29/005* (2013.01); *F25D 2700/08* (2013.01)

(58) Field of Classification Search
CPC ..... F25D 2700/08; F25D 29/005
USPC ..... 62/80, 126, 127; 700/22, 55, 278
See application file for complete search history.

(56) References Cited

U.S. PATENT DOCUMENTS

| | | | |
|---|---|---|---|
| 2,354,964 | A | 8/1944 | Ostermann et al. |
| 4,044,354 | A | 8/1977 | Bosher et al. |
| 4,099,167 | A | 7/1978 | Pomerantz et al. |

(Continued)

FOREIGN PATENT DOCUMENTS

| | | | |
|---|---|---|---|
| DE | 3633086 | A1 | 6/1987 |
| JP | H08313326 | A | 11/1996 |

OTHER PUBLICATIONS

Zheng, et al., Fast Dynamic Liquid Level Sensor Based on Liquid Resistance, AFRICON 2007, Sep. 26-28, 2007, pp. 1-6.

(Continued)

*Primary Examiner* — Henry Crenshaw
(74) *Attorney, Agent, or Firm* — Michael S. Hargis; King & Schickli, PLLC

(57) ABSTRACT

A system for facilitating communication of information between an information source positioned inside a refrigerated environment and a position outside the refrigerated environment comprising a transmitter for transmitting a signal including the information, a planar antenna fixed to a gasket for resonating the transmitted signal, the gasket providing a seal between the refrigerated compartment and a door providing access to the refrigerated compartment, and a receiver for receiving the signal including the information. The information could include information concerning at least one container positioned in a refrigerated environment. The system may utilize a Wi-Fi device, a Bluetooth® device, RFID device, or other devices for transmitting the information.

24 Claims, 3 Drawing Sheets

(56) References Cited

U.S. PATENT DOCUMENTS

| | | | | |
|---|---|---|---|---|
| 4,201,085 | A | 5/1980 | Larson | |
| 4,242,685 | A * | 12/1980 | Sanford | H01Q 13/18 343/700 MS |
| 4,489,601 | A | 12/1984 | Rao et al. | |
| 4,495,807 | A | 1/1985 | Field et al. | |
| 4,956,560 | A | 9/1990 | Smith, Jr. et al. | |
| 5,275,951 | A | 1/1994 | Chow et al. | |
| 5,423,206 | A | 6/1995 | Hetzel | |
| 5,437,184 | A | 8/1995 | Shillady | |
| 5,583,544 | A | 12/1996 | Stamer et al. | |
| 5,609,059 | A | 3/1997 | McEwan | |
| 5,797,515 | A | 8/1998 | Liff et al. | |
| 5,880,364 | A | 3/1999 | Dam | |
| 6,039,467 | A | 3/2000 | Holmes | |
| 6,233,434 | B1 * | 5/2001 | Takei | H01Q 1/246 455/103 |
| 6,474,156 | B1 | 11/2002 | Endo et al. | |
| 6,546,795 | B1 | 4/2003 | Dietz | |
| 6,564,658 | B2 | 5/2003 | Pchelnikov et al. | |
| 6,703,935 | B1 * | 3/2004 | Chung | H04L 63/12 340/572.1 |
| 6,822,618 | B2 | 11/2004 | Bisiules et al. | |
| 6,959,598 | B2 | 11/2005 | Peterson et al. | |
| 6,962,078 | B2 | 11/2005 | Angal et al. | |
| 7,258,005 | B2 | 8/2007 | Nyce et al. | |
| 7,340,951 | B2 | 3/2008 | Nyce et al. | |
| 7,458,260 | B2 | 12/2008 | Roesner | |
| 7,592,963 | B2 * | 9/2009 | Cheng | H01Q 13/10 343/769 |
| 8,467,981 | B2 | 6/2013 | Mukherjee et al. | |
| 8,526,935 | B2 | 9/2013 | Besore | |
| 2006/0132312 | A1 * | 6/2006 | Tavormina | B66F 9/0755 340/572.7 |
| 2007/0152048 | A1 * | 7/2007 | Jung | G06Q 10/087 235/385 |
| 2007/0169549 | A1 | 7/2007 | Kwun et al. | |
| 2008/0036829 | A1 | 2/2008 | Nishioka et al. | |
| 2008/0105331 | A1 | 5/2008 | You et al. | |
| 2008/0291435 | A1 | 11/2008 | Murakami | |
| 2009/0289536 | A1 * | 11/2009 | Park | F25D 23/028 312/405 |
| 2010/0250009 | A1 * | 9/2010 | Lifson | F24F 11/006 700/278 |
| 2010/0280771 | A1 * | 11/2010 | Mukherjee | G01F 23/2845 702/55 |
| 2011/0140972 | A1 * | 6/2011 | Besore | H01Q 1/007 343/702 |
| 2011/0248725 | A1 | 10/2011 | Mukherjee | |
| 2013/0257644 | A1 | 10/2013 | Mukherjee et al. | |
| 2013/0265190 | A1 | 10/2013 | Mukherjee et al. | |

OTHER PUBLICATIONS

Ilev, et al., All-Fiber-Optic Evanescent Liquid Level and Leak Sensor, Lasers and Electro-Optics, 1999, May 23-28, 1999, pp. 157-158.

James, et al., A Long Period Grating Liquid Level Sensor, Optical Fiber Sensors Conference Technical Digest, 2002, vol. 1, pp. 127-130.

Royer, et al., A Liquid Level Sensor Using the Absorption of Guided Acoustic Waves, Ultrasonics, Ferroelectrics and Frequency Control., vol. 40, Iss. 4, Jul. 1993, pp. 418-421.

Sanchez-Galicia, et al., Acoustic-Based Liquid Level Determination in Process Vessels Using PVDF Sensors, Instrumentation and Measurement Technology Conference, 2006, Apr. 24-27, 2006, pp. 1770-1773.

Spratt, W.K.; Vetelino, J.F., Torsional Acoustic Waveguide Sensor for Temperature and Liquid Level, Frequendy Control Symposium, 2009, Apr. 20-24, 2009, pp. 850-854.

Li et al., Development of Magnetostriction Sensor for on-line Liquid Level and Density Measurement, Intelligent Control and Automation, 2006, vol. 1, pp. 5162-5166.

Somnath Mukherjee; "Non-invasive Measurement of Liquid Content inside a Small Vial"; RWS '10 Proceedings of the 2010 IEEE Conference on Radio & Wireless Symposium; IEEE Press Piscataway, NJ, USA; pp. 527-530.

Dr. Somnath Mukherjee; "Non-Invasive Measurement of Liquid Content inside a Small Container"; Oral Presentation; 2010 IEEE Radio Radio & Wireless Symposium, New Orleans, USA, Jan. 13, 2010; pp. 1-23.

D. P. Seliskar, et al.; "Proportional Microvolume Capacitive Liquid Level Sensor Array"; Proceedings of the 2005 IEEE; Engineering in Medicine and Biology 27th Annual Conference; Shanghai, China, Sep. 1-4, 2005; pp. 7258-7261.

Christopher P. Nemarich; "Time Domain Reflectometry Liuid Level Sensors"; IEEE Instrumentation & Measurement Magazine, Dec. 2001, pp. 40-44.

Gabor Vass; "The Principles of Level Measurement"; Sensors Magazine, vol. 17, Oct. 1, 2000.

R.M.A. Azzam; "Light-Reflection Liquid-Level Sensor"; IEEE Transactions on Instrumentation and Measurement, vol. 29, No. 2, Jun. 1980; pp. 113-115.

F. Lucklum, et al.; "Principle of a non-contact liquid level sensor using electromagentic-acoustic resonators"; Elektrotechnik and Informationstechnik, vol. 126, No. 1-2, Feb. 2009; pp. 3-4.

Annapurna Das, et al.; "Microwave Engineering"; Tata McGraw Hill Education Private Limited, Nagar, New Delhi, 2009.

"Non-Invasive Measurement and Management of Liquid Levels in Multiple-dose Injectable Medication Sealed Vials"; Dec. 2, 2011; 18 pages.

* cited by examiner

SYSTEM FOR FACILITATING COMMUNICATION OF INFORMATION AND RELATED METHODS

This application claims the benefit of U.S. Provisional Patent Application No. 61/728,964, filed Nov. 21, 2012, the disclosure of which is incorporated herein by reference.

FIELD OF THE INVENTION

The present invention relates generally to a communication system; and more particularly to a system for facilitating communication of information between a position inside a refrigerated environment and a position outside the refrigerated environment.

BACKGROUND OF THE INVENTION

The healthcare industry is moving rapidly to digitize patient and inventory information in the form of electronic medical records. This move is motivated by cost savings, privacy needs, enhanced accountability, and, to a large extent, by existing and anticipated state and federal government regulations. U.S. government agencies are encouraging electronic medical record (EMR) adoption by the year 2015 by providing economic incentives for early adapters and penalties for late adapters. Although, EMR systems are more advanced for human health, the concept is beginning to be implemented for animal health applications for cost, inventory control and traceability advantages.

The assignee of the present invention has developed products that can provide relevant data to EMR systems and desires to extend this technology for utilization in refrigerated environments. The current products, for example, can obtain and store all information concerning medicinal containers and vials (e.g., remaining liquid/solid doses, manufacturer, lot number, expiration date, temperature, and additional related information) and provide the full search capability needed to monitor health and usage trends.

For example, this technology can be applied to the myriad of multi-dose vials used for allergy injections and other interventions in hospitals, physician offices (particularly allergists), public health centers, and veterinary service centers including animal feeding operations. Advantageously, these products would provide significant annual cost savings for human and animal health applications, respectively. The savings stem from reduced medication waste and lower inventory management costs.

In both human and animal pharmaceutical markets, liquid medications are provided in multi-dose vials. Currently, the management of vial inventories, including refrigerated inventories, is manual and hence problematic. Vials are often lost at the back or on the bottom shelves within the refrigerated environment. As a result, some vials reach their expiration date and must be discarded resulting in a loss of expensive medication.

Although a few technologies are available that make EMR adaptation feasible for collecting and managing solid medication inventories, when it comes to liquids, especially in enclosed multi-dose vials such as injectable medications stored inside a refrigerator, adequate technology to remotely and non-invasively measure and manage liquid inventories does not exist.

Accordingly, a system for facilitating communication of information between an information source positioned inside a refrigerated environment and a position outside the refrigerated environment is needed. Preferably, the system would further be able to sense an amount of content in at least one container positioned inside the refrigerated environment and transmit information concerning same to the position outside the refrigerated environment. In addition, the information could include any relevant information including EMR related information and could be transmitted from the outside to the inside, vice versa, or in both directions depending on need. All of these features are provided by the following invention.

SUMMARY OF THE INVENTION

The present invention meets these needs by providing a system for facilitating communication of information between an information source positioned inside a refrigerated environment and a position outside the refrigerated environment. In accordance with a first aspect of the present invention, the system includes a transmitter for transmitting a signal including the information, a planar antenna fixed to a gasket for resonating the transmitted signal, the gasket providing a seal between the refrigerated compartment and a door providing access to the refrigerated compartment, and a receiver for receiving the signal including the information. In one embodiment, the transmitter is positioned inside the refrigerated environment and the receiver is positioned outside of the refrigerated environment. The reverse scenario is also possible.

In accordance with another aspect of the invention, the planar antenna is a resonant antenna including an aperture which resonates at at least one frequency. The aperture generates stronger signal currents thereby improving the communication of information. In one embodiment, the planar antenna is a resonant antenna including at least two apertures or an array of apertures, each of the at least two apertures resonating at at least one frequency. In this embodiment, the at least two apertures generate stronger signal currents and focus the transmitted signal to improve the communication of information.

In accordance with still another aspect of the invention, the transmitter and receiver may be transceivers providing for bi-directional communication.

In accordance with yet another aspect of the invention, a method of facilitating communication of information between a position inside a refrigerated environment and a position outside the refrigerated environment is disclosed. The method includes the steps of transmitting a signal including the information, resonating the transmitted signal using a planar antenna fixed to a gasket, the gasket providing a seal between the refrigerated compartment and a door providing access to the refrigerated compartment, and receiving the signal including the information. In one embodiment, the step of transmitting occurs inside the refrigerated environment and the step of receiving occurs outside of the refrigerated environment. The method may further include the step of sensing an amount of content in at least one container when the at least one container is positioned within the refrigerated environment. Even more, the transmitted information may include at least the amount of content in the at least one container.

In accordance with still another aspect of the invention, the planar antenna used to resonate the signal may include an aperture which resonates at at least one frequency. The aperture generates stronger signal currents thereby improving the communication of information. In one embodiment, the planar antenna may be a resonant antenna including at least two apertures, each of the at least two apertures resonating at at least one frequency. In this embodiment, the at least two apertures generate stronger signal currents and focus the transmitted signal to improve the communication of information.

In accordance with another aspect of the invention, a system for providing information concerning at least one container positioned in a refrigerated environment includes a content sensing system for determining an amount of content in the at least one container when the at least one container is positioned within a refrigerated compartment, a transmitter positioned inside of the refrigerated compartment for transmitting the information including at least the amount of content in the at least one container, a planar antenna fixed to a gasket for resonating the information including at least the amount of content in the at least one container, the gasket providing a seal between the refrigerated compartment and a door providing access to the refrigerated compartment, and a receiver positioned outside of the refrigerated compartment for receiving the information including at least the amount of content in the at least one container. In addition, the information transmitted may further include at least one of a name of medication, an expiration date, a national drug code number, a lot number, a name of manufacturer, temperature inside the refrigerated environment, and/or humidity inside the refrigerated environment.

The amount of content in the at least one container may be determined by detecting a content-air interface within the at least one container. In one embodiment, determining the amount of content may be done using a non-invasive content sensing system. Such a non-invasive content sensing system may include a platform supporting the at least one container, at least one holder associated with the at least one container supported by the platform, a source for generating a radio frequency signal, circuitry in communication with said at least one holder for transmitting the radio frequency signal through the at least one holder into the at least one container and receiving a portion of the radio frequency signal reflected at a content-air interface in the at least one container, and circuitry for processing the reflected radio frequency signal and determining the amount of content in the at least one container.

An alternate non-invasive content sensing system may include a tray supporting the at least one container, a source for generating a radio frequency signal, at least one launcher associated with the at least one container supported by the tray for launching the radio frequency signal, circuitry in communication with the at least one launcher for transmitting the radio frequency signal into the at least one container and receiving a portion of the radio frequency signal reflected at a content-air interface in the at least one container, and circuitry for processing the received reflected radio frequency signal and determining the amount of content in the at least one container.

In accordance with another aspect of the invention, the planar antenna is a resonant antenna including an aperture which resonates at at least one frequency. The aperture generates stronger signal currents thereby improving the communication of information. In one embodiment, the planar antenna is a resonant antenna including at least two apertures, each of the at least two apertures resonating at at least one frequency. In this embodiment, the at least two apertures generate stronger signal currents and focus the transmitted signal to improve the communication of information.

In accordance with still another aspect of the invention, the transmitter may be a transceiver and the receiver a transceiver providing for bi-directional communication.

These and other embodiments of the present invention will be set forth in the description which follows, and in part will become apparent to those of ordinary skill in the art by reference to the following description of the invention and referenced drawings or by practice of the invention. The claims, however, indicate the particularities of the invention.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to an embodiment of the invention, an example of which is illustrated in the accompanying drawings.

DETAILED DESCRIPTION OF THE PREFERRED EMBODIMENT

In the following detailed description of the illustrated embodiments, reference is made to the accompanying drawings that form a part hereof, and in which is shown by way of illustration, specific embodiments in which the invention may be practiced. These embodiments are described in sufficient detail to enable those skilled in the art to practice the invention and like numerals represent like details in the various figures. Also, it is to be understood that other embodiments may be utilized and that process, mechanical, electrical, arrangement, software and/or other changes may be made without departing from the scope of the present invention. In accordance with the present invention, methods and systems are hereinafter described for facilitating communication of information between an information source positioned inside a refrigerated environment and a position outside the refrigerated environment.

In the described embodiment, the system facilitates communication of information concerning medication containers stored in commercially available refrigerators to an outside network which in this instance is an Electronic Medical Records (EMR) network. Importantly, the system utilizes an antenna to mitigate the refrigerator's shielding effect. The antenna is fixed to a gasket that provides a seal between a refrigerated compartment of the refrigerator and a door providing access to the refrigerated compartment. The system 10 transmits the information, which, in this instance, includes content level data for containers stored in the refrigerator, and may transmit additional information (e.g., type of medication, manufacturer, lot number, expiration date, and temperature, among other information) to the antenna which resonates the signal to a receiver outside of the refrigerator.

Figure 1:
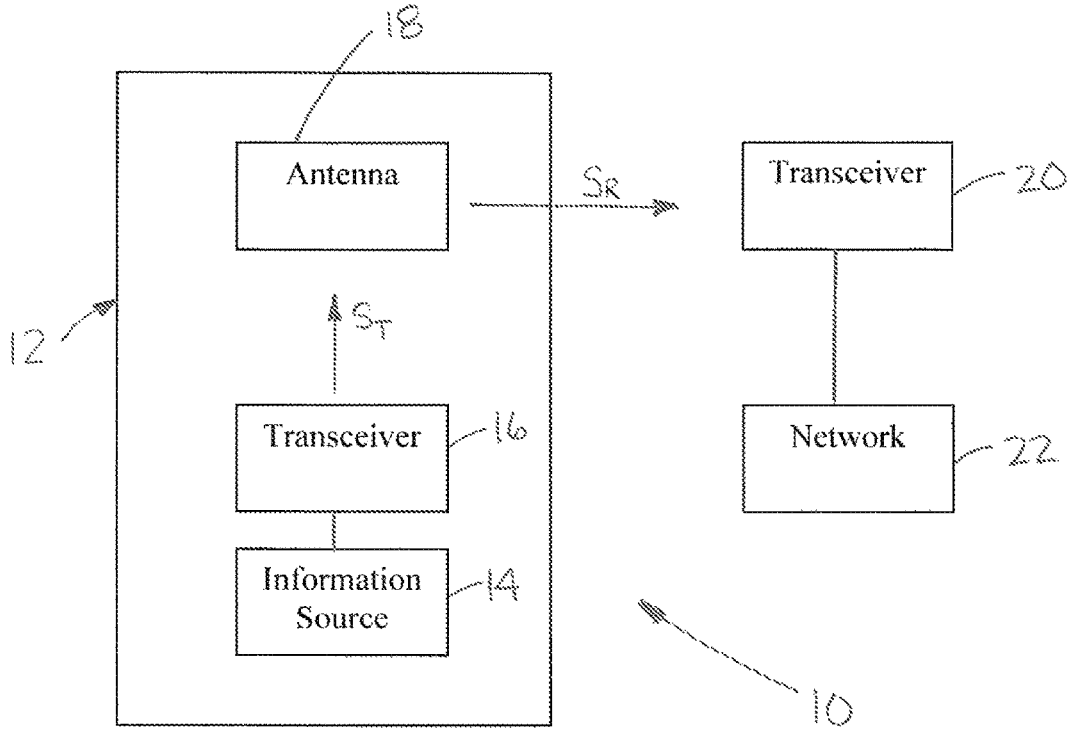
FIG. 1 is a block diagram of a representative system for communicating information from inside a refrigerated environment to a position outside of the refrigerated environment.

As shown in FIG. 1, the system 10 includes a refrigerated environment 12 having an information source 14, a first transceiver 16, and an antenna 18 therein. The transceiver 16 transmits a signal indicative of the information provided by the information source 14. The transmitted signal $S_T$ is resonated by the antenna 18 and received by a second transceiver 20 positioned outside of the refrigerated environment 12. The received signal $S_R$ including the information is passed to a network 22.

The first and second transceivers 16 and 20 together form a wireless link capable of transmitting and receiving data from inside the refrigerated environment 12 to a network 22, reliably and consistently, despite the shielding effect of the refrigerated environment. In this embodiment, a Wi-Fi (IEEE 802.11 x) system operating at 2.4 GHz is utilized to transmit signals $S_T$ from inside the shielded environment of the refrigerator 12 to the outside network 22. The shielding effect of the refrigerator 12, however, has a deleterious effect on data rate and reliability of operation. This is the reason antenna 18 is utilized to reduce or overcome this deleterious effect.

It should be understood by those skilled in the art that other methods of transmitting signals from within the refrigerator 12 to a position outside of the refrigerator may be used in accordance with the present invention. For example, the transmitter could be the WiFi transceivers 16, 20 or other types of commonly known transmitters, such as transceivers or transponders, (e.g., Bluetooth® devices, or radio frequency identification (RFID) devices) operating at different frequencies for transmitting the information. It should also be appreciated that signals may be transmitted from outside of the refrigerator and received inside of the refrigerator, in addition to being transmitted from inside to outside, or signals may be transmitted in both directions utilizing the first and second transceivers.

Figure 2:
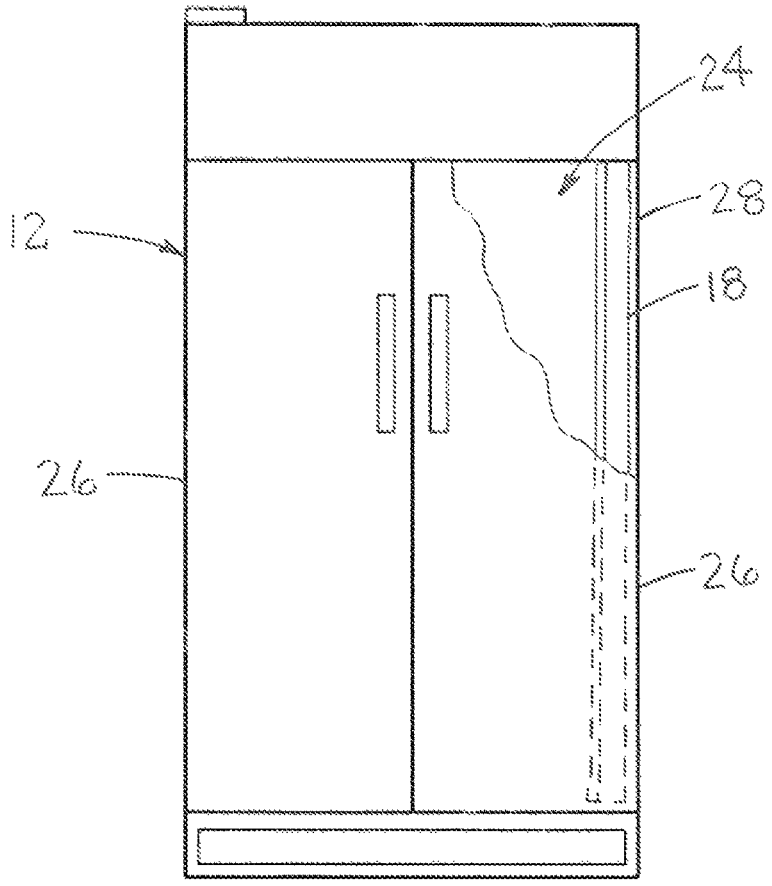
FIG. 2 is a front view of a commercial refrigerator with a door shown partially cutaway to reveal an antenna fixed to a gasket that provides a seal between a refrigerated compartment of the refrigerator and the door.

As shown in FIG. 2, the refrigerated environment 12 of the system 10 is provided by a commercial refrigerator having a refrigerated compartment 24 and a door 26. A gasket 28 provides a seal between the refrigerated compartment 24 and the door 26. The refrigerated environment 12 could also be an industrial refrigerator, a walk in cooler, a freezer, or similar environment, having a refrigerated compartment and a gasket providing a seal between the refrigerated compartment and a door providing access to the refrigerated compartment.

As is well known, all refrigerators use a gasket for mechanical sealing. The presence of the gasket reduces a shielding effectiveness (SE) of the refrigerator. The SE is defined by the following formula:

$$SE=20*\log(E_0/E_s)$$

where $E_0$ is the observed field in absence of the shield, and $E_s$ is the observed field in presence of the shield, both measured at the same point. As SE decreases, more radiation can be transmitted from a position inside of the refrigerator to a position outside of the refrigerator, or vice-versa.

In its simplest configuration, the refrigerator can be modeled as a metallic box with a continuous endless slot (aperture) along its periphery. The transmission cross-section, σ, of an aperture is defined by the following formula:

$$P=\sigma\times S_j$$

where P is the power transmitted through the aperture, and $S_j$ is the incident power density.

Although diffraction through an aperture is a well-studied topic, most approaches assume that the aperture is a flat, perfectly-conducting screen of infinite size and zero thickness. The typical refrigerator gasket, however, usually has a complex geometry. Hence, it is difficult to treat analytically using aperture diffraction theory. In addition, the aperture is situated on a metallic cavity. Accordingly, the configuration should be modeled as a cavity problem using modal analysis rather than as an aperture on a flat plane.

Numerical techniques, including ray tracing, have been used extensively to determine the SE of enclosures with apertures. When calculating high values of SE, the numerical methods must seek to achieve high accuracy. For the present invention, however, the intent is to minimize SE, ideally to 0 decibel (dB). Therefore, accuracy is not paramount, and semi-empirical approximate formulas can provide sufficient insight into the required antenna design parameters.

In principle, SE can be estimated by using Huygens' s Equivalence Principle, where the electric field along an endless slot (gasket) is replaced by equivalent magnetic currents. That is, an approximate model of a refrigerator leaking radio-frequency energy to the outside can be created by considering sheets of magnetic current along the gasket regions. Determinations of such fields, however, are beset with the problem of randomness as follows: (1) the contents inside a refrigerator have a random nature in terms of size, shape, material content, and organization, which change from time to time; (2) no assumption can be made regarding the homogeneity of the dielectric constant inside the refrigerator; and (3) conducting items of various sizes and shapes could be present. Therefore, a statistical model is more appropriate for this scenario. Such methods are capable of providing an estimate of the distribution of the slot impedance and SE. Furthermore, the magnitude of electromagnetic fields inside the cavity (refrigerator) can be assumed to be statistically uniform.

This model, though approximate, can provide insight into the radiation from a leaking cavity (refrigerator). If the magnitude and phase of the magnetic current sheet can be determined at all points along the gasket, the radiation pattern at every point in the space external to the refrigerator can be determined at least in principle. Because the radiation pattern depends not only on the magnitude but also on the phase of the magnetic current, however, the radiation pattern is difficult to estimate analytically, even when using statistical methods. Consequently, the magnitude and phase of the field at the gasket regions were determined experimentally with subsequent conversion to an equivalent magnetic current. This approach provides a realistic estimate of the leakage and radiation pattern.

The present invention utilizes the above model to determine the SE for a refrigerator and its radiation pattern. SE measurements of the radiation outside an actual refrigerator were used to validate the model. An equivalent magnetic current sheet model was developed to demonstrate that the radiation transfer is occurring through the gasket.

The following assumptions represent the basis for this model. First, the refrigerator is electrically large. Even the smallest refrigerator dimensions (few hundred cm) are several times the wavelength corresponding to the frequencies that will be used in a 2.4 GHz Wi-Fi (IEEE 802.11 x) system, for example. Second, the behavior of fields inside the refrigerator will be similar to a reverberation chamber, due to the numerous internal reflections inside the cavity. Except near the walls, these multiple reflections will be manifested as standing waves that create near uniform fields.

In other words, the field inside the cavity will be statistically uniform, implying that the Root Mean Squared value of the field will be independent of position. The magnitude of the power density (Poynting Vector) inside the cavity when vector integrated over 4π steradians will have an average value of zero, but will possess a finite variance. The average value of the energy density ($\epsilon\cdot E^2$) will be statistically uniform inside the cavity. These assumptions allow SE to be formulated as a ratio of the power density outside the cavity to the energy density inside the cavity. Then, SE can be expressed as the following equation ("Equation 3"):

$$SE=10\mathrm{Log}(2\pi V/\sigma\lambda Q)$$

where V=volume of the cavity, σ=transmission cross-section defined in Equation 2, λ=wavelength, and Q=quality factor of the cavity.

In order to validate the model, the SE was calculated from measurements using a Vector Network Analyzer (VNA). A dipole antenna operating at 2.4 GHz was located inside the refrigerator and connected to Port 1 of the analyzer. Another dipole antenna was located outside the refrigerator and connected to Port 2 of the analyzer. Low loss flexible cables were used to connect the dipoles to the analyzer so that the antennas were moveable as necessary. A VNA calibration (without the antennas) was used to remove the effect of the cables. In order to take the measurements set forth in this paragraph, IEEE STD-299-199713 was adhered to.

The VNA provided scattering parameters (S-parameters) from a sample transmission. S-parameters describe the electrical behavior of linear electrical networks when undergoing various steady state stimuli by electrical signals. S21 is the forward voltage gain and it was used to calculate the shielding effectiveness for different conditions of frequency, polarization, incident angle, refrigerator contents, and location of the test dipoles. Finally, the experimentally determined SE was compared to that estimated from Equation 3.

The magnitude and phase of the electric field (using the S21 data from the VNA) was determined at various points along the gasket and other potential leakage regions. For each such point in space (corresponding to leakage regions), data was recorded for three orthogonal directions (x, y, z). The electric field along various points of the gasket (or other leakage regions) was used to construct an equivalent magnetic current sheet model. This model was based solely on the leakage regions and excluded the geometry of the refrigerator. The equivalent magnetic current model was run to predict the radiation pattern at points in the space surrounding the refrigerator. A commercially available electromagnetic simulator, such as High Frequency Structural Simulator (HFSS), was used to implement the magnetic current sheet model.

The radiation pattern generated by an actual refrigerator was experimentally determined and compared with the results obtained from the magnetic current sheet model. Good agreement verified that the radiation transfer from the inside to the outside of the refrigerator was occurring through the gasket. Having established that the refrigerator gasket is the source of radiation leakage, an antenna was able to be designed to take advantage of this leakage.

Figure 3:
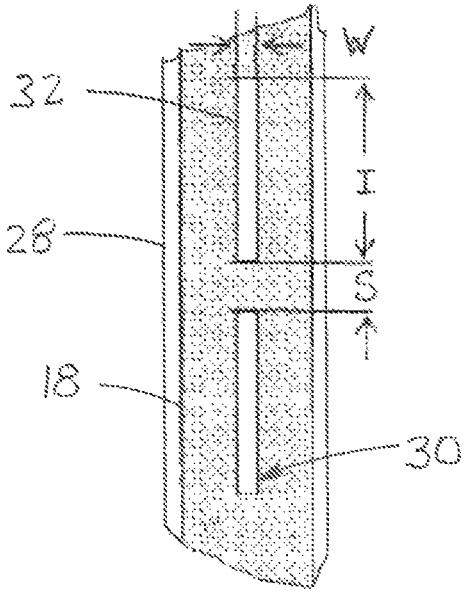
FIG. 3 is a partial plan view of an exemplary antenna fixed to a gasket.

As shown in FIG. 3, the antenna 18 selected for this embodiment is fixed or mounted on gasket 28. More specifically, the antenna 18 is a planar antenna and utilizes an array of slots 30 or apertures. The apertures resonate at a particular frequency and thereby generate stronger radio frequency currents. As a result, the transmitted signal $S_T$ is increased in strength.

The antenna 18 may be designed to resonate at single or multiple frequencies (e.g., 2.4 GHz can be used for Wifi or Bluetooth® and 900 MHz for RFID). A length, I, of a first aperture 32 of the array of apertures 30 may be adjusted to be resonant at the frequency of interest, which is expected to be approximately half a wavelength. The width, W, of the first aperture 32 is the predominant factor in determining bandwidth. The spacing, S, determines an array factor and hence a radiation pattern.

In another embodiment, the antenna could include a single aperture. The multiple or array of apertures 30 were selected because they provide a focusing of the transmitted signal $S_T$ making the signal even stronger. Further focusing could be achieved using dielectric layers as well. In an array of apertures antenna, the apertures are subjected to propagating transverse electromagnetic field excitation and the diffracted field on the other side of the aperture is calculated at a suitable point. The length I and width W may be adjusted to maximize the diffracted field over >20 MHz bandwidth. A small number (e.g., less than four) of array apertures were initially utilized. The spacing was varied to maximize the diffracted field at the monitoring point over >20 MHz bandwidth. The directivity provided by the array was calculated and compared to a single aperture configuration. Finally, the effect of the refrigerator's electrically large cavity on the array of apertures antenna was considered.

In the present embodiment, the antenna 18 is fabricated on a flexible substrate (e.g., low cost printed circuit board (PCB) material) using standard printing or etching techniques. The antenna 18 is fixed to the gasket 28 that provides a seal between the refrigerated compartment 24 of the refrigerator 12 and the door 26 which provides access to the refrigerated compartment. More specifically, the antenna 18 was adhered to the gasket 28 using an adhesive backing or similar adhesive material. Of course, the antenna 18 could be fixed to the gasket 28 using other methods as are know in the art.

The antenna 18 of the present embodiment also incorporates the following features: (1) presence of both front and back lobes to ensure wave propagation between the outside and the inside of the refrigerator 12; (2) reasonably consistent polarization, substantially insensitive to contents inside the refrigerator; and (3) sufficient bandwidth to accommodate 20 MHz channels operating at 2.4GHz, Wi-Fi (IEEE 802.11x).

The antenna 18 is fed without a physical connection from the first transceiver 16. More specifically, an antenna of the first transceiver 16 located inside the refrigerator 12. A similar second transceiver 20 is located outside of the refrigerator 12 as shown in FIG. 1. During testing, the transceivers 16, 20 were interfaced to a bit-error-rate tester (BERT), which monitors the error rate in the data transmission.

After completing BERT testing, the antenna 18 was integrated with a commercially available Wi-Fi (802.11g) device interfaced to an information source 14. In the present embodiment, the information source 14 is a content level sensing system designed by the assignee of the present invention. The content level sensing system is described in detail in U.S. Pat. No. 8,467,981 to Muhkerjee et al. the full disclosure of which is incorporated herein by reference. An alternate content level sensing system is likewise described in detail in published U.S. 2011/0248725 to Muhkerjee the full disclosure of which is incorporated herein by reference.

Other information sources of any kind whatsoever can be utilized in accordance with the broad teaching of the present invention to supply information to the system. For example, a temperature sensing device could provide information concerning the temperature within the refrigerator 12, a humidity sensing device could provide information concerning the humidity level within the refrigerator, a meter could be used to monitor power conditions of the refrigerator, or a scale could be utilized to provide information concerning the weight of one or more objects stored in the refrigerator. Again, the information source 14 could be any device capable of providing information to the system 10.

A measurement on the delay spread (and hence quality factor, Q) was undertaken to determine if the delay spread could possibly have a detrimental effect on the maximum data rates. A pulsed RF source was used to characterize the delay spread. Based on this information, the distribution of the delay and upper limits of the data rate were determined.

As noted above, the antenna 18 of the present embodiment does not utilize a physical feed between the antenna 18 and the transceiver 16. This is attractive from a customer's point of view. However, a physically connected feed may alternately be used so long as the antenna selected has a geometry suitable for attaching to a gasket. For example, a leaky antenna or a dipole parallel to defected ground structure (DGS) antenna which rely on physical feeds could be utilized.

In addition, software was developed for the management and display of the information. The software is responsible for acquiring EMR-relevant information, such as, content level, type of medication, and expiration date, from the platforms or trays described in assignee's issued patent and published patent application. This is accomplished by calling drivers normally available with commercial Wi-Fi devices. The information is displayed on a user friendly graphical interface and delivered to a data base stored on the network 22 or otherwise. The development process utilizes hypertext preprocessor (PHP), a general-purpose server-side scripting language for interfacing to the hardware drivers and the display. The software is integrated with structured query language (MYSQL), which is a popular open source database for the web.

The software manages and displays information on content levels and on remaining numbers of doses. As noted above, alternate embodiments of the present invention could display such additional information as medication type, manufacturer, lot number, expiration date, temperature, and additional information.

In the present embodiment, the network 22 refers to an EMR network. However, the network 22 may include any telecommunications or computer network that communicatively couples the transceiver 20 with other devices. In one embodiment, the network 2 may include any type of data network or combination of data networks including, but not limited to, a local area network (LAN), a medium area network, or a wide area network such as the Internet. The network 22, for example, may be a wired or wireless network that allows the transceiver 20 to communicate with other devices. The network 22 may further support world-wide-web protocols and services.

In use, the system 10 facilitates communication of information between a position inside a refrigerated environment 24 and a position outside the refrigerated environment. A signal including the information is transmitted by a transceiver 16 to an antenna 18 fixed to a gasket 28 which resonates the transmitted signal $T_s$ thereby strengthening and/or focusing the signal. The gasket 28 provides a seal between a refrigerated compartment 24 and a door 26 providing access to the refrigerated compartment. The transmitted signal $T_s$ including the information is received by a transceiver 20. In one embodiment, the transmitting occurs inside the refrigerated environment and the receiving occurs outside of the refrigerated environment. The system 10 may be utilized in the reverse, as well, or could be designed to transmit and receive inside and outside of the refrigerated environment.

In addition, an amount of content in at least one container when the at least one container is positioned within the refrigerated environment 24 may be sensed by an information source 14. This sensed content level, and possibly additional information concerning the container and/or contents thereof, may comprise the information to be transmitted by the system. Additional information may also be transmitted.

The antenna 18 is used to resonate the transmitted signal $T_s$ at at least one frequency. The aperture 32 of the antenna 18 generates stronger signal currents thereby improving the communication of information. In an alternate embodiment, the antenna 18 may include at least two apertures, or an array of apertures 30, each of the apertures resonating at at least one frequency. In this embodiment, the array of apertures 30 generates stronger signal currents and focuses the transmitted signal $T_s$ to improve the communication of information.

The breadth and scope of the present invention should not be limited by any of the above-described exemplary embodiments, but should be defined only in accordance with the following claims and their equivalents. Ultimately, skilled artisans should recognize at least the following advantages. Namely, they should appreciate that the foregoing supports facilitating the communication of information between a position inside a refrigerated environment and a position outside the refrigerated environment. Naturally, any improvements along such lines should contemplate good engineering practices, such as simplicity, ease of implementation, unobtrusiveness, stability, etc.

The foregoing has been described in terms of specific embodiments, but one of ordinary skill in the art will recognize that additional embodiments are possible without departing from its teachings. This detailed description, therefore, and particularly the specific details of the exemplary embodiments disclosed, is given primarily for clarity of understanding, and no unnecessary limitations are to be implied. Modifications will become evident to those skilled in the art upon reading this disclosure and may be made without departing from the spirit or scope of the invention. Relatively apparent modifications, of course, include combining the various features of one or more figures with the features of one or more of the other figures.

The invention claimed is:

1. A system for facilitating communication of information between an information source positioned inside a refrigerated environment and a position outside the refrigerated environment comprising:

a transmitter for transmitting a signal including the information;

a planar antenna fixed to a gasket for resonating the transmitted signal, said gasket providing a seal between the refrigerated compartment and a door providing access to the refrigerated compartment; and a receiver for receiving the signal including the information.

2. The system of claim 1, wherein the transmitter is positioned inside the refrigerated environment and the receiver is positioned outside of the refrigerated environment.

3. The system of claim 1, wherein said planar antenna is a resonant antenna including an aperture which resonates at at least one frequency.

4. The system of claim 3, wherein said aperture generates stronger signal currents thereby improving the communication of information.

5. The system of claim 1, wherein said planar antenna is a resonant antenna including at least two apertures, each of said at least two apertures resonating at at least one frequency.

6. The system of claim 5, wherein said at least two apertures focus the transmitted signal thereby improving the communication of information.

7. The system of claim 1, wherein said transmitter is a transceiver and said receiver is a transceiver.

8. A method of facilitating communication of information between a position inside a refrigerated environment and a position outside the refrigerated environment comprising:

transmitting a signal including the information;

resonating the transmitted signal using a planar antenna fixed to a gasket, said gasket providing a seal between the refrigerated compartment and a door providing access to the refrigerated compartment; and receiving the signal including the information.

9. The method of claim 8, wherein the step of transmitting occurs inside the refrigerated environment and the step of receiving occurs outside of the refrigerated environment.

10. The method of claim 8, wherein said planar antenna includes an aperture which resonates at at least one frequency.

11. The method of claim 10, wherein said aperture generates stronger signal currents thereby improving the communication of information.

12. The method of claim 8, wherein said planar antenna includes at least two apertures, each of said at least two apertures resonating at at least one frequency.

13. The method of claim 12, wherein said at least two apertures focus the signal thereby improving the communication of information.

14. The method of claim 8, further comprising the step of sensing an amount of content in at least one container when the at least one container is positioned within the refrigerated environment; and wherein the transmitted information includes at least the amount of content in the at least one container.

15. A system for providing information concerning at least one container positioned in a refrigerated environment comprising:

a non-invasive content sensing system for determining an amount of content in the at least one container when the at least one container is positioned within a refrigerated compartment;

a transmitter positioned inside of the refrigerated compartment for transmitting the information including at least the amount of content in the at least one container;

a planar antenna fixed to a gasket for resonating the information including at least the amount of content in the at least one container, said gasket providing a seal between the refrigerated compartment and a door providing access to the refrigerated compartment; and a receiver positioned outside of the refrigerated compartment for receiving the information including at least the amount of content in the at least one container;

wherein said non-invasive content sensing system includes a platform supporting the at least one container, at least one holder associated with said at least one container supported by said platform, a source for generating a radio frequency signal, circuitry in communication with said at least one holder for transmitting the radio frequency signal through said at least one holder into the at least one container and receiving a portion of the radio frequency signal reflected at a content-air interface in the at least one container, and circuitry for processing the reflected radio frequency signal and determining the amount of content in the at least one container.

16. The system of claim 15, wherein said non-invasive content sensing system includes a tray supporting the at least one container, a source for generating a radio frequency signal, at least one launcher associated with said at least one container supported by said tray for launching the radio frequency signal, circuitry in communication with said at least one launcher for transmitting the radio frequency signal into the at least one container and receiving a portion of the radio frequency signal reflected at a content-air interface in the at least one container, and circuitry for processing the received reflected radio frequency signal and determining the amount of content in the at least one container.

17. The system of claim 15, wherein the information transmitted further includes at least one of name of medication, expiration date, national drug code number, lot number, name of manufacturer, temperature inside the refrigerated environment, and humidity inside the refrigerated environment.

18. The system of claim 15, wherein said planar antenna is a resonant antenna including an aperture which resonates at at least one frequency.

19. The system of claim 18, wherein said aperture generates stronger signal currents thereby improving the communication of information.

20. The system of claim 15, wherein said planar antenna is a resonant antenna including at least two apertures, each of said at least two apertures resonating at at least one frequency.

21. The system of claim 20, wherein said at least two apertures focus the signal thereby improving the communication of information.

22. The system of claim 15, wherein said transmitter is a transceiver and said receiver is a transceiver.

23. The method of claim 14, wherein the step of sensing an amount of content in the at least one container includes the step of detecting a content-air interface within the at least one container.

24. The method of claim 14, wherein the step of sensing an amount of content in the at least one container is performed non-invasively.

* * * * *